US012768069B2

(12) United States Patent
Ko et al.

(10) Patent No.: US 12,768,069 B2
(45) Date of Patent: Oct. 20, 2026

(54) APPARATUS FOR MANUFACTURING COPPER FOIL

(71) Applicant: SK NEXILIS CO., LTD., Jeongeup-si Jeollabuk-do (KR)

(72) Inventors: Su Jeong Ko, Jeongeup-si Jeollabuk-do (KR); Hye Won Kim, Jeongeup-si Jeollabuk-do (KR); Dong Woo Kim, Jeongeup-si Jeollabuk-do (KR)

(73) Assignee: SK NEXILIS CO., LTD., Jeongeup-si (KR)

( * ) Notice: Subject to any disclaimer, the term of this patent is extended or adjusted under 35 U.S.C. 154(b) by 696 days.

(21) Appl. No.: 18/132,153

(22) Filed: Apr. 7, 2023

(65) Prior Publication Data

US 2023/0407513 A1 Dec. 21, 2023

(30) Foreign Application Priority Data

Jun. 17, 2022 (KR) ..... 10-2022-0074191

(51) Int. Cl.
*C25D 17/12* (2006.01)
*C25D 1/04* (2006.01)
*C25D 3/38* (2006.01)

(52) U.S. Cl.
CPC ..... *C25D 17/12* (2013.01); *C25D 1/04* (2013.01); *C25D 3/38* (2013.01)

(58) Field of Classification Search
None
See application file for complete search history.

(56) References Cited

U.S. PATENT DOCUMENTS 5,344,538 A 9/1994 Chamberlain et al.
10,975,487 B1 * 4/2021 Huang ..... H01M 4/661

FOREIGN PATENT DOCUMENTS

CN 207918974 U 9/2018
CN 207918976 U 9/2018
CN 110042439 A 7/2019
CN 113026061 A 6/2021
JP H0987883 A 3/1997
(Continued)

OTHER PUBLICATIONS

English translation KR20200141369 (Year: 2020).*
(Continued)

*Primary Examiner* — Stefanie S Wittenberg
(74) *Attorney, Agent, or Firm* — Crowell & Moring LLP

(57) ABSTRACT

An apparatus for manufacturing copper foil is provided, including: an electrodeposition unit to electrodeposit a copper foil and a winding unit to wind the copper foil supplied therefrom, wherein the electrodeposition unit includes a negative drum and a positive electrode unit electrically connected thereto, the positive electrode unit includes a positive electrode body spaced apart from the negative drum, a plurality of positive electrode plates disposed on a surface of the positive electrode body, and a plurality of fastening units fastening each of the positive electrode plates to the positive electrode body, including first and second positive ones of the positive electrode plates coupled to the positive electrode body by first and second ones of the fastening units, and the second positive electrode plate includes a covering member that covers the first fastening member and a coupling member into which the second fastening member is inserted.

10 Claims, 7 Drawing Sheets

(56) References Cited

FOREIGN PATENT DOCUMENTS

| | | | |
|---|---|---|---|
| JP | H11302900 | A | 11/1999 |
| JP | 2019099897 | A | 6/2019 |
| KR | 20200141369 | A | 12/2020 |
| TW | 273578 | B | 4/1996 |
| TW | 201038775 | A | 11/2010 |

OTHER PUBLICATIONS

English translation CN207918976 (Year: 2018).*
Extended European Search Report for related European Application No. 23179463.7; action dated Nov. 2, 2023; (8 pages).
Office Action for related Taiwanese Application No. 11221302730; action dated Dec. 26, 2023; (4 pages).
Office Action for related Japanese Application No. 2023-041850; action dated May 21, 2024; (2 pages).

* cited by examiner

APPARATUS FOR MANUFACTURING COPPER FOIL

CROSS-REFERENCE TO RELATED APPLICATIONS

This application claims the benefit of the Korean Patent Applications No. 10-2022-0074191 filed on Jun. 17, 2022, which are hereby incorporated by reference as if fully set forth herein.

FIELD

The present disclosure relates to an apparatus for manufacturing a copper foil used for manufacturing various products such as a negative electrode for a secondary battery, a flexible printed circuit board, etc.

BACKGROUND

Copper foils are used for manufacturing various products such as negative electrodes for secondary batteries, flexible printed circuit boards (FPCBs), etc. The copper foils are manufactured through an electroplating method in which an electrolyte is supplied between a positive electrode and a negative electrode and then a current flows therebetween.

In manufacturing the copper foils through the electroplating method as described above, an apparatus for manufacturing a copper foil is used. The apparatus for manufacturing a copper foil includes a negative electrode drum for electrodepositing the copper foil using the electroplating method using an electrolyte, a positive electrode plate electrically connected to the negative electrode drum through the electrolyte, and a positive electrode body for supporting the positive electrode plate. The positive electrode plate is coupled to the positive electrode body through a base fastening member such as a screw.

Here, in the apparatus for manufacturing a copper foil according to the related art, the base fastening member and the positive electrode plate may be coupled to the positive electrode body to be spaced different distances from the negative electrode drum due to an assembly step. Therefore, in the apparatus for manufacturing a copper foil according to the related art, as current density is formed differently around the base fastening member and the positive electrode plate, current density in the electrolyte is not uniformly formed. Therefore, in the apparatus for manufacturing a copper foil according to the related art, since a thickness of the copper foil electrodeposited on the negative electrode drum is not formed uniformly, there is a problem that the quality of the copper foil is degraded.

SUMMARY

The present disclosure is directed to providing an apparatus for manufacturing a copper foil capable of preventing the quality of the copper foil from being degraded as current density is not uniformly formed due to a base fastening member.

In order to achieve the object, the present disclosure may include the following configuration.

An apparatus for manufacturing a copper foil according to the present disclosure may include an electrodeposition unit on which the copper foil is electrodeposited in an electroplating method using an electrolyte and a winding unit configured to wind the copper foil supplied from the electrodeposition unit. The electrodeposition unit may include a negative electrode drum on which an electrodeposited copper foil is electrodeposited in the electroplating method using the electrolyte and a positive electrode unit electrically connected with the negative electrode drum through the electrolyte. The positive electrode unit may include a positive electrode body spaced apart from the negative electrode drum, a plurality of positive electrode plates disposed on an upper surface of the positive electrode body, and a plurality of fastening units fastening each of the positive electrode plates to the positive electrode body. A first positive electrode plate among the positive electrode plates may be coupled to the positive electrode body by a first fastening member among the fastening members. A second positive electrode plate among the positive electrode plates may be coupled to the positive electrode body by a second fastening member among the fastening members. The second positive electrode plate may include a second covering member disposed on an upper surface of the first positive electrode plate to cover the first fastening member and a second coupling member into which the second fastening member is inserted.

According to the present disclosure, it is possible to achieve the following effects.

According to the present disclosure, base fastening units for coupling positive electrode plates to a positive electrode body can be implemented to be covered by different positive electrode plates so as not to be directly exposed to the outside. Therefore, according to the present disclosure, by reducing a deviation of current density formed around the positive electrode plate, it is possible to improve the uniformity of the current density in an electrolyte. Therefore, according to the present disclosure, it is possible to manufacture a copper foil having improved quality.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Hereinafter, an apparatus for manufacturing a copper foil according to embodiments of the present disclosure will be described in detail with reference to the accompanying drawings.

Figure 1:
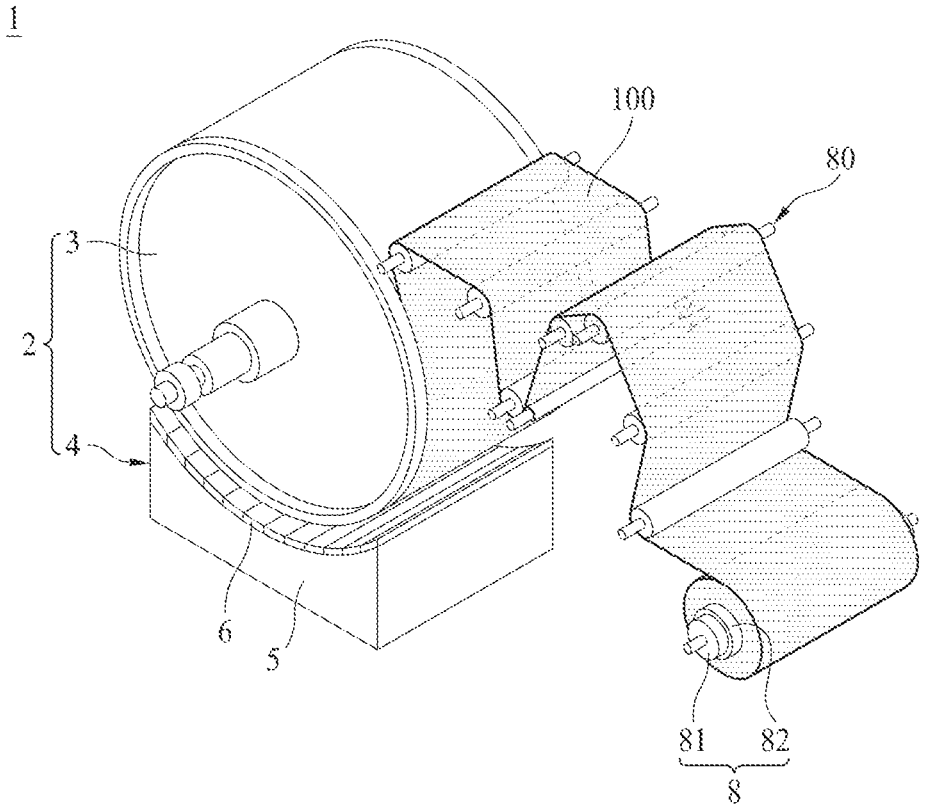
FIG. 1 is a schematic perspective view of an apparatus for manufacturing a copper foil according to the present disclosure.
Figure 2:
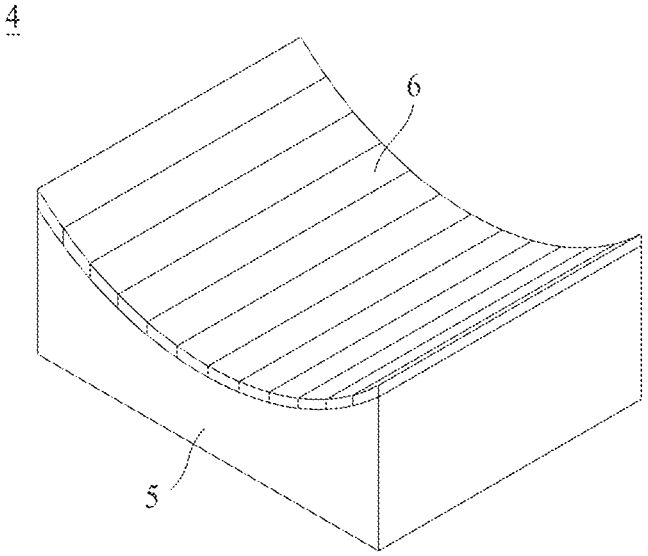
FIG. 2 is a schematic perspective view of a positive electrode unit in the apparatus for manufacturing a copper foil according to the present disclosure.

Referring to FIG. 1, an apparatus 1 for manufacturing a copper foil according to the present disclosure manufactures a copper foil 100 using an electroplating method. The apparatus 1 for manufacturing a copper foil according to the present disclosure may include an electrodeposition unit 2 and a winding unit 8.

Referring to FIG. 1, the electrodeposition unit 2 electrodeposits a copper foil 100. The electrodeposition unit 2 may electrodeposit the copper foil 100 in the electroplating method using an electrolyte. The electrodeposition unit 2 may include a negative electrode drum 3 and a positive electrode unit 4. When the negative electrode drum 3 and the positive electrode unit 4 are electrically connected through the electrolyte and a current flows therebetween, copper ions dissolved in the electrolyte may be reduced on the negative electrode drum 3. Therefore, the electrodeposition unit 2 may electrodeposit the copper foil 100 on a surface of the negative electrode drum 3.

The negative electrode drum 3 may rotate about a rotational shaft. The negative electrode drum 3 may consecutively perform an electrodepositing operation of electrodepositing the copper foil 100 on the surface thereof and an unwinding operation of separating the electrodeposited copper foil 100 from the surface while rotating about the rotational shaft. The negative electrode drum 3 may be formed in a drum shape as a whole, but is not limited thereto and may also be formed in a different shape as long as it may consecutively perform the electrodepositing operation and the unwinding operation while rotating about the rotational shaft. The negative electrode drum 3 may be rotated by a driving force generated by a negative electrode mechanism (not shown). The negative electrode drum 3 may be coupled to a frame (not shown). Although not shown, the frame may be installed on a bottom surface of a workshop in which the apparatus 1 for manufacturing a copper foil according to the present disclosure is installed.

The positive electrode unit 4 is electrically connected with the negative electrode drum 3 through the electrolyte. The positive electrode unit 4 may be disposed under the negative electrode drum 3. The positive electrode unit 4 may be disposed to be spaced apart from the surface of the negative electrode drum 3. A surface of the positive electrode unit 4 and the surface of the negative electrode drum 3 may be formed in the same shape. For example, when the negative electrode drum 3 is formed in a circular rectangular shape to have a curved surface, the positive electrode unit 4 may be formed in a semicircular rectangular shape to have a curved surface.

Referring to FIG. 1, the winding unit 8 winds the copper foil 100. The copper foil 100 manufactured by the electrodeposition unit 2 may be wound around the winding unit 8. The winding unit 8 may be coupled to the frame.

The winding unit 8 may include a winding roller 81. The winding roller may wind the copper foil 100 while rotating about the rotational shaft. The winding roller 81 may be formed in a drum shape as a whole, but is not limited thereto and may also be formed in other shapes as long as it may wind the copper foil 100 while rotating about the rotational shaft. The winding roller 81 may be rotated by a driving force generated by a winding mechanism (not shown).

A core 82 may be included in the winding unit 8. The core 82 may be mounted on the winding roller 81 to surround the winding roller 81. As the winding roller 81 rotates, the copper foil 100 may be wound around the core 82. The core 82 may be detachably included in the winding unit 8. Therefore, when the winding of the copper foil 100 around the core 82 is completed or a defect occurs, a replacement operation of separating the core 82 from the winding unit 8 and mounting a new core 82 may be performed. Meanwhile, the core 82 and the winding roller 81 may also be integrally formed. In this case, when the winding of the copper foil 100 around the core 82 is completed, the core 82 and the winding roller 81 may be integrally separated and then conveyed to equipment for a subsequent process.

The copper foil 100 may be conveyed from the electrodeposition unit 2 to the winding unit 8 by the conveying unit 80. The conveying unit 80 conveys the copper foil 100. In the process of conveying the copper foil 100 from the electrodeposition unit 2 to the winding unit 8 by the conveying unit 80, an operation of drying the copper foil 100, an operation of performing rust prevention treatment on the copper foil 100, and an operation of cutting a portion of the copper foil 100 may be performed. The conveying unit 80 may be disposed between the electrodeposition unit 2 and the winding unit 8. The conveying unit 80 may be coupled to the frame. The conveying unit 80 may include a conveying roller. The conveying roller may convey the copper foil 100 from the electrodeposition unit 2 to the winding unit 8 while rotating about a rotational shaft. The conveying roller may be formed in a drum shape as a whole, but is not limited thereto and may also be formed in other shapes as long as it may convey the copper foil 100 while rotating about the rotational shaft. The conveying unit 80 may also include a plurality of conveying rollers. The conveying rollers may be disposed at positions spaced apart from each other to convey the copper foil 100. At least one of the conveying rollers may be rotated by a driving force generated by a conveying mechanism (not shown).

Here, the apparatus 1 for manufacturing a copper foil according to the present disclosure can be implemented to improve the uniformity of current density in the electrolyte positioned between the negative electrode drum 3 and the positive electrode unit 4. To this end, the positive electrode unit 4 in the apparatus 1 for manufacturing a copper foil according to the present disclosure can be implemented as follows.

Referring to FIGS. 1 to 4, the positive electrode unit 4 may include a positive electrode body 5, a plurality of positive electrode plates 6, and a plurality of fastening units 7.

The positive electrode body 5 is spaced apart from the negative electrode drum 3. The positive electrode plates 6 may be coupled to the positive electrode body 5. The positive electrode body 5 may support the positive electrode plates 6. The positive electrode body 5 may be disposed under the negative electrode drum 3 to be spaced apart from the negative electrode drum 3. The positive electrode body 5 may be coupled to the frame.

The positive electrode plates 6 are disposed on an upper surface of the positive electrode body 5. The positive electrode plates 6 may be disposed on the upper surface of the positive electrode body 5 to be electrically connected with the negative electrode drum 3 through the electrolyte. The positive electrode plates 6 may be disposed between the positive electrode body 5 and the negative electrode drum 3. The positive electrode plates 6 may be disposed to cover the upper surface of the positive electrode body 5. In this case, the positive electrode plates 6 may be installed in a form corresponding to the upper surface of the positive electrode body 5 and disposed to cover the entire upper surface of the positive electrode body 5. In the apparatus 1 for manufacturing a copper foil according to the present disclosure, the positive electrode unit 4 may be formed through a coupling operation of pressing and coupling the positive electrode plates 6 to the positive electrode body 5.

The fastening units 7 couple each of the positive electrode plates 6 to the positive electrode body 5.

The fastening units 7 may be formed to pass through the positive electrode plates 6. The fastening units 7 pass through the positive electrode plate 6 and are coupled to the positive electrode body 5 so that the positive electrode body 5 and the positive electrode plates 6 may be coupled. A plurality of fastening units 7 may be formed on the positive electrode plate 6.

Referring to FIGS. 3 to 6, a first positive electrode plate 61 among the positive electrode plates 6 may be coupled to the positive electrode body 5 by a first fastening member 71 among the fastening units 7. A second positive electrode plate 62 among the positive electrode plates 6 may be coupled to the positive electrode body 5 by a second fastening member 72 among the fastening units 7. In this case, the second positive electrode plate 62 may include a second covering member 621 disposed on an upper surface of the first positive electrode plate 61 to cover the first fastening member 71 and a second coupling member 622 into which the second fastening member 72 is inserted. Therefore, the apparatus 1 for manufacturing a copper foil according to the present disclosure can be implemented so that the first fastening member 71 is not exposed to the outside through the second covering member 621. Therefore, the apparatus 1 for manufacturing a copper foil according to the present disclosure can reduce a deviation of current density formed around the positive electrode plates 6, thereby improving the uniformity of the current density in the electrolyte. Therefore, the apparatus 1 for manufacturing a copper foil according to the present disclosure can improve the uniformity of the thickness of the copper foil 100, thereby manufacturing the copper foil 100 having more improved quality.

Hereinafter, a description will be given on the basis of the fact that the positive electrode plates 6 include the first positive electrode plate 61, the second positive electrode plate 62, and a base positive electrode plate 63 with reference to the accompanying drawings. The number of positive electrode plates 6 is not limited thereto, and four or more positive electrode plates 6 may also be formed to cover the entire upper surface of the positive electrode body 5.

Referring to FIGS. 3 to 6, the first positive electrode plate 61 may include a first covering member 611 and a first coupling member 612.

The first covering member 611 may be coupled to the positive electrode body 5 to overlap a portion of the base positive electrode plate 63. The first covering member 611 may be disposed to cover the portion of the base positive electrode plate 63. In this case, the first covering member 611 may be disposed on an upper surface of the base positive electrode plate 63. The first coupling member 612 may be disposed to be spaced apart from the first covering member 611. The first coupling member 612 may be disposed to cover a portion of the positive electrode body 5. In this case, the first coupling member 612 may be disposed on the upper surface of the positive electrode body 5.

Referring to FIGS. 3 to 6, the first positive electrode plate 61 may include a first bending member 613.

The first bending member 613 connects the first covering member 611 and the first coupling member 612. The first bending member 613 may be disposed between the first covering member 611 and the first coupling member 612 to connect the first covering member 611 and the first coupling member 612. In this case, the first bending member 613 may be bent so that the first covering member 611 and the first coupling member 612 are disposed at different heights. In other words, the first covering member 611 and the first coupling member 612 may be disposed to be spaced different distances from the positive electrode body 5 by the first bending member. For example, when the first positive electrode plate 61 is coupled to the positive electrode body 5, the first coupling member 612 may be coupled in close contact with the positive electrode body 5. On the other hand, when the first positive electrode plate 61 is coupled to the positive electrode body 5, the first covering member 611 may be disposed to be spaced a predetermined distance from the positive electrode body 5. The base positive electrode plate 63 may be disposed between the first covering member 611 and the positive electrode body 5.

Referring to FIGS. 3 to 6, the first positive electrode plate 61 may include a first coupling groove 614 and a first covering groove 615.

The first coupling groove 614 is disposed above the first coupling member 612. The second positive electrode plate 62 may be disposed in the first coupling groove 614. The second positive electrode plate 62 may be disposed in the first coupling groove 614 and disposed to cover the first coupling member 612.

The first covering groove 615 is disposed under the first covering member 611. The base positive electrode plate 63 may be disposed in the first covering groove 615. A portion of the base positive electrode plate 63 may be disposed in the first covering groove 615. The covering groove may be a space disposed between the first covering member 611 and the positive electrode body 5. When the base positive electrode plate 63 is disposed in the first covering groove 615, the first covering member 611 may be disposed to cover a base fastening member 73 among the fastening units 7. Therefore, the apparatus 1 for manufacturing a copper foil according to the present disclosure can be implemented so that the base fastening member 73 is not exposed to the outside through the first covering member 611. Therefore, the apparatus 1 for manufacturing a copper foil according to the present disclosure can reduce the deviation of the current density formed around the positive electrode plates 6, thereby improving the uniformity of the current density in the electrolyte. Therefore, the apparatus 1 for manufacturing a copper foil according to the present disclosure can improve the uniformity of the thickness of the copper foil 100, thereby manufacturing the copper foil 100 having more improved quality.

Figure 5:
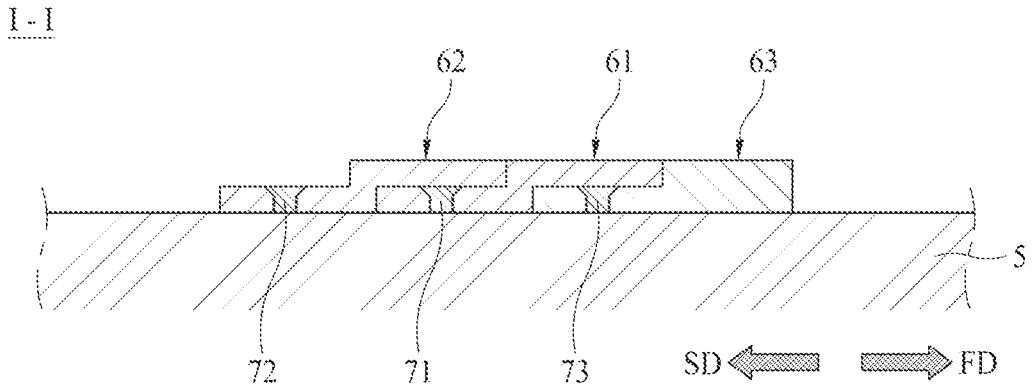
FIG. 5 is a schematic cross-sectional view of the positive electrode plate along line I-I of FIG. 3 in the apparatus for manufacturing a copper foil according to the present disclosure.
Figure 6:
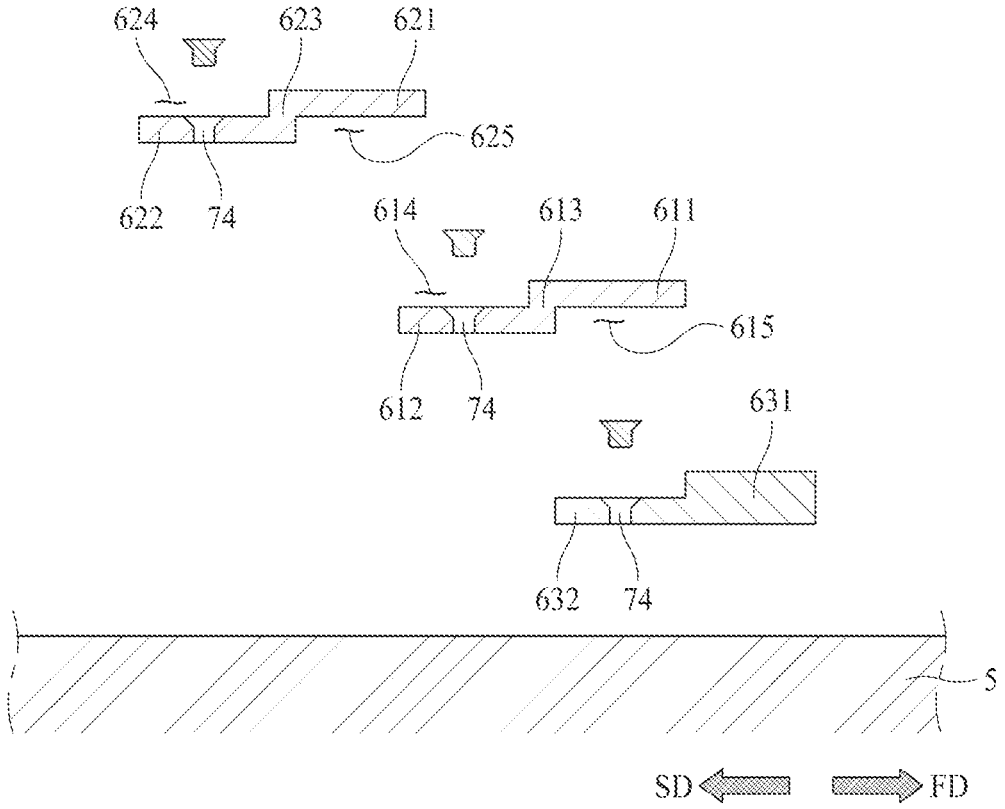
FIG. 6 is an exploded view of the positive electrode plate of FIG. 5.
Figure 7:
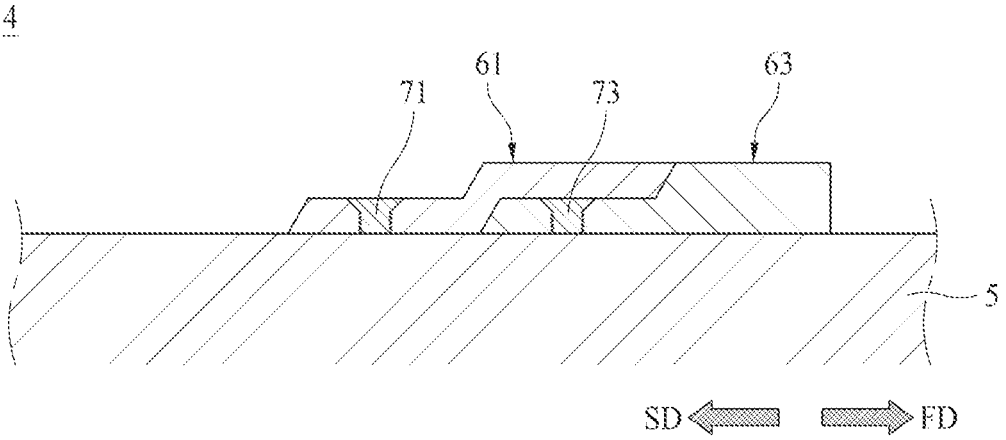
FIG. 7 is a conceptual diagram showing a modified embodiment of the positive electrode plate in the apparatus for manufacturing a copper foil according to the present disclosure.
Figure 8:
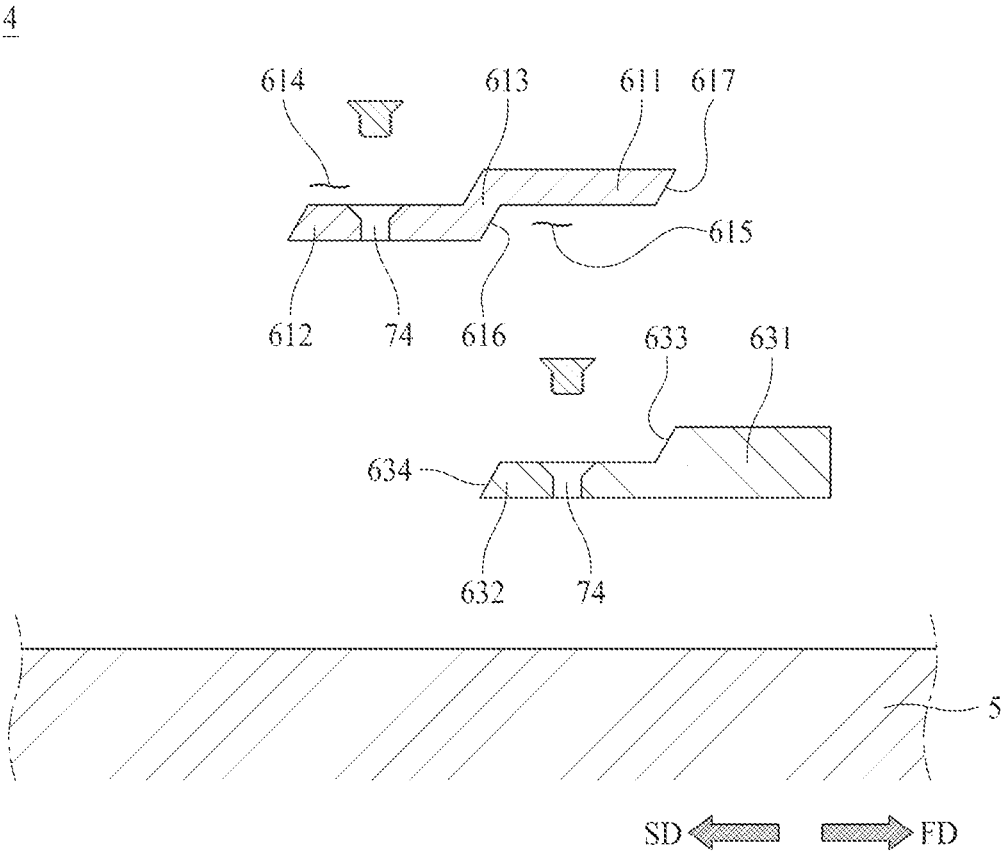
FIG. 8 is an exploded view of the positive electrode plate of FIG. 7.
Figure 9:
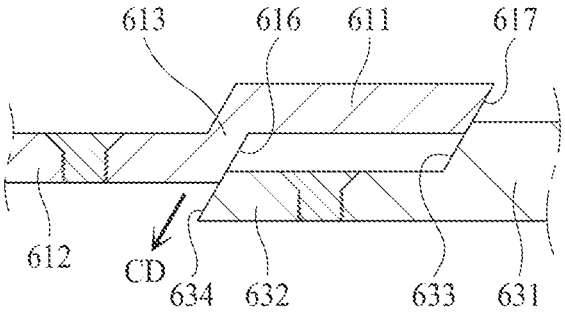
FIG. 9 is a conceptual diagram showing a state in which the positive electrode plates according to the modified embodiment are coupled in the apparatus for manufacturing a copper foil according to the present disclosure.

Referring to FIGS. 5 and 6, the first covering member 611 may be formed to have a uniform thickness as the first covering member 611 extends in a first direction (arrow direction indicated by FD) from the first positive electrode plate 61 toward the second positive electrode plate 62. The first coupling member 612 may be formed to have a uniform thickness as the first coupling member 612 extends in a second direction (arrow direction indicated by SD) opposite to the first direction (arrow direction indicated by FD). The first covering member 611 may be disposed on an upper surface of the second base member 632 and disposed at the same height as the first base member 631.

Referring to FIGS. 3 to 6, the second positive electrode plate 62 may include the second coupling member 622 and the second covering member 621.

The second fastening member 72 is inserted into the second coupling member 622. Fastening holes 74 into which the second fastening member 72 is inserted may be formed in the second coupling member 622. In this case, the second fastening member 72 may be inserted into the second coupling member 622 to pass through the fastening hole 74. The second coupling member 622 may be coupled to the positive electrode body 5 through the second fastening member 72.

The second covering member 621 is spaced apart from the second coupling member 622. The second covering member 621 may be disposed to overlap a portion of the first positive electrode plate 61. The second covering member 621 may be disposed to overlap the first coupling member 612. In this case, the second covering member 621 may be disposed on the first coupling member 612 and disposed so that an upper surface of the second covering member 621 and an upper surface of the first covering member 611 form one connected surface.

Referring to FIGS. 3 to 6, the second positive electrode plate 62 may include a second bending member 623.

The second bending member 623 is disposed between the second coupling member 622 and the second covering member 621. The second bending member 623 may be disposed between the second coupling member 622 and the second covering member 621 to connect the second coupling member 622 and the second covering member 621. In this case, the second bending member 623 may be formed in a bent shape so that the second coupling member 622 and the second covering member 621 are disposed at different heights. In other words, the second covering member 621 and the second coupling member 622 may be disposed to be spaced different distances from the positive electrode body 5 by the second bending member 623. For example, when the second positive electrode plate 62 is coupled to the positive electrode body 5, the second coupling member 622 may be coupled in close contact with the positive electrode body 5. On the other hand, when the second positive electrode plate 62 is coupled to the positive electrode body 5, the second covering member 621 may be disposed to be spaced a predetermined distance from the positive electrode body 5.

Referring to FIGS. 3 to 6, the second positive electrode plate 62 may include a second coupling groove 624 and a second covering groove 625.

The second coupling groove 624 is disposed above the second coupling member 622. When the positive electrode plates 6 are disposed to partially overlap each other in the second direction (arrow direction indicated by SD), any one of the positive electrode plates 6 may be disposed in the second coupling groove 624.

The second covering groove 625 is disposed under the second covering member 621. The second covering groove 625 may be disposed between the second covering member 621 and the positive electrode body 5. In this case, the first coupling member 612 may be inserted into the second covering groove 625. Therefore, the second covering member 621 may be disposed to cover the first fastening member 71. Therefore, the apparatus 1 for manufacturing a copper foil according to the present disclosure can be implemented so that the first fastening member 71 is not exposed to the outside through the second covering member 621. Therefore, the apparatus 1 for manufacturing a copper foil according to the present disclosure can reduce a deviation of current density formed around the positive electrode plates 6, thereby improving the uniformity of the current density in the electrolyte. Therefore, the apparatus 1 for manufacturing a copper foil according to the present disclosure can improve the uniformity of the thickness of the copper foil 100, thereby manufacturing the copper foil 100 having more improved quality.

Referring to FIGS. 3 to 6, the positive electrode plate 6 may include the base positive electrode plate 63.

The base positive electrode plate 63 is disposed in the first direction (arrow direction indicated by FD) with respect to the first positive electrode plate 61. The base positive electrode plate 63 may be coupled to the positive electrode body 5. The base positive electrode plate 63 may be coupled to the positive electrode body 5 between a left end of the positive electrode body 5 and a right end of the positive electrode body 5. When the base positive electrode plate 63 is coupled to the left end of the positive electrode body 5, the first positive electrode plate 61 may be disposed on a right side of the base positive electrode plate 63 and coupled to the positive electrode body 5. When the base positive electrode plate 63 is coupled to the right end of the positive electrode body 5, the first positive electrode plate 61 may be disposed on a left side of the base positive electrode plate 63 and coupled to the positive electrode body 5. The base positive electrode plate 63 may be coupled to the positive electrode body 5 between the left end of the positive electrode body 5 and the right end of the positive electrode body 5. The positive electrode plates 6 may be consecutively disposed to partially overlap each other in a direction in which the first positive electrode plate 61 and the second positive electrode plate 62 are disposed with respect to the base positive electrode plate 63. Therefore, in the apparatus 1 for manufacturing a copper foil according to the present disclosure, the positive electrode plates 6 may be disposed to cover the entire upper surface of the positive electrode body 5.

Referring to FIGS. 3 to 6, the base positive electrode plate 63 may include a first base member 631 and a second base member 632.

The first base member 631 is spaced apart from the first positive electrode plate 61. The first base member 631 may be formed to have a greater thickness than the second base member 632. In other words, an upper surface of the first base member 631 may be disposed at a higher position than an upper surface of the second base member 632.

The second base member 632 is covered by the first covering member 611. The second base member 632 may be inserted into the first covering groove 615 and covered by the first covering member 611. In this case, the first covering member 611 may be disposed to cover the base fastening member 73 formed on the second base member 632.

The second base member 632 may be coupled to the first base member 631. The second base member 632 may be coupled to the first base member 631 to protrude toward the second direction (arrow direction indicated by SD). The first covering member 611 may be disposed on the second base member 632 and disposed so that the upper surface of the first covering member 611 and the upper surface of the first base member 631 form one connected surface. Therefore, in the apparatus 1 for manufacturing a copper foil according to the present disclosure, since upper surfaces of the positive electrode plates 6 may be formed at the same height, the upper surfaces of the positive electrode plates 6 can be implemented to form one connected surface. For example, as shown in FIGS. 5 and 6, a portion in which the second covering member 621 and the first covering member 611 overlap and a portion in which the first covering member 611 and the first base member 631 overlap can be implemented in the same form. Therefore, the second covering member 621, the first covering member 611, and the first base member 631 may be coupled to be implemented in a flat plate shape.

Referring to FIGS. 3 to 6, the fastening unit 7 may include the first fastening member 71, the second fastening member 72, and the base fastening member 73. In this case, a plurality of fastening holes 74 for coupling the first fastening member 71, the second fastening member 72, and the base fastening member 73 may be formed in the first positive electrode plate 61, the second positive electrode plate 62, and the base positive electrode plate 63.

The first fastening member 71 couples the first positive electrode plate 61 to the positive electrode body 5. The first fastening member 71 may pass through the first positive electrode plate 61 and may be coupled to the positive electrode body 5. In this case, the first fastening member 71 may be coupled to the first positive electrode plate 61 to pass through the fastening hole 74. The first fastening member 71 may pass through the fastening hole 74 formed in the first coupling member 612 and may be coupled to the positive electrode body 5. When a plurality of first fastening members 71 are formed on the first positive electrode plate 61, the number of fastening holes 74 formed in the first coupling member 612 may be formed to correspond to the number of first fastening members 71.

The second fastening member 72 couples the second positive electrode plate 62 to the positive electrode body 5. The second fastening member 72 may pass through the second positive electrode plate 62 and may be coupled to the positive electrode body 5. In this case, the second fastening member 72 may be coupled to the second positive electrode plate 62 to pass through the fastening hole 74. The second fastening member 72 may pass through the fastening hole 74 formed in the second coupling member 622 and may be coupled to the positive electrode body 5. When a plurality of second fastening members 72 are formed on the second positive electrode plate 62, the number of fastening holes 74 formed in the second coupling member 622 may be formed to correspond to the number of second fastening members 72.

The base fastening member 73 couples the base positive electrode plate 63 to the positive electrode body 5. The base fastening member 73 may pass through the base positive electrode plate 63 and may be coupled to the positive electrode body 5. In this case, the base fastening member 73 may be coupled to the base positive electrode plate 63 to pass through the fastening hole 74. The base fastening member 73 may pass through the fastening hole 74 formed in the first base member 631 and may be coupled to the positive electrode body 5. When a plurality of base fastening members 73 are formed on the base positive electrode plate 63, the number of fastening holes 74 formed in the first base member 631 may be formed to correspond to the number of base fastening members 73.

Hereinafter, a modified embodiment of the positive electrode plates 6 will be described with reference to FIGS. 2, 7, 8, and 9. In this case, since the second positive electrode plate 62 may be formed to be substantially the same as the first positive electrode plate 61, the coupling relationship of the positive electrode plates 6 in another modified embodiment based on the first positive electrode plate 61 and the base positive electrode plate 63 will be described.

The first positive electrode plate 61 may include the first bending member 613 disposed to be inclined. The first bending member 613 may be disposed to be inclined from the first coupling member 612 in the first direction (arrow direction indicated by FD) toward the first covering member 611. In this case, the first bending member 613 may be disposed to be inclined at a predetermined angle in the first direction (arrow direction indicated by FD) with respect to the positive electrode body 5. When the first bending member 613 is disposed to be inclined, the first positive electrode plate 61 may include a bending inclined surface 616 formed on the first bending member 613. The bending inclined surface 616 may be a surface disposed to face the base positive electrode plate 63.

The base positive electrode plate 63 may include a first inclined surface 633 formed on the first base member 631 to be disposed to face the bending inclined surface 616. In this case, the first positive electrode plate 61 may be coupled to the base positive electrode plate 63 so that the bending inclined surface 616 moves along the first inclined surface 633. Therefore, in the apparatus 1 for manufacturing a copper foil according to the present disclosure, a coupling operation of coupling the first positive electrode plate 61 and the base positive electrode plate 63 may be easily performed through the bending inclined surface 616 and the first inclined surface 633. The first positive electrode plate 61 may be moved in a coupling direction CD from the first positive electrode plate 61 toward the positive electrode body 5.

When the bending inclined surface 616 is formed on the first bending member 613, a covering inclined surface 617 may be formed on the first covering member 611. The covering inclined surface 617 may be formed on a front end of the first covering member 611 disposed in the first direction (arrow direction indicated by FD). The covering inclined surface 617 may be disposed to face the base positive electrode plate 63. When the first covering member 611 includes the covering inclined surface 617, the base positive electrode plate 63 may include a second inclined surface 634 formed on the second base member 632 disposed to face the covering inclined surface 617. In this case, the first positive electrode plate 61 may be coupled to the base positive electrode plate 63 so that the covering inclined surface 617 moves along the second inclined surface 634. Therefore, in the apparatus 1 for manufacturing a copper foil according to the present disclosure, the coupling of the first positive electrode plate 61 is guided at a plurality of points through the covering inclined surface 617 and the second inclined surface 634, and thus the coupling operation of coupling the positive electrode plate 61 and the base positive electrode plate 63 may be easily performed.

Hereinafter, another modified embodiment of the positive electrode plates 6 will be described with reference to FIGS. 2, 3, 10, and 11. In this case, since the second positive electrode plate 62 may be formed to be substantially the same as the first positive electrode plate 61, the coupling relationship of another modified embodiment with respect to the first positive electrode plate 61 and the base positive electrode plate 63 will be described.

Figure 10:
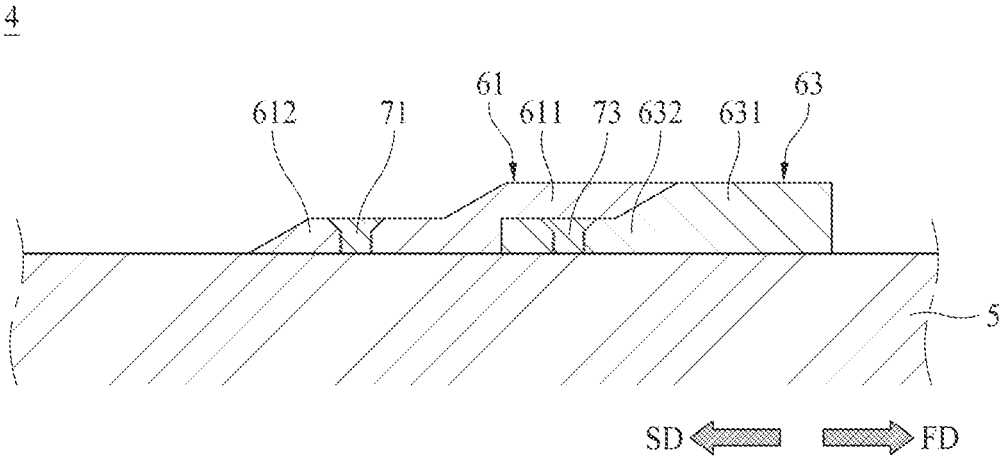
FIG. 10 is a conceptual diagram showing another modified embodiment of the positive electrode plate in the apparatus for manufacturing a copper foil according to the present disclosure.
Figure 11:
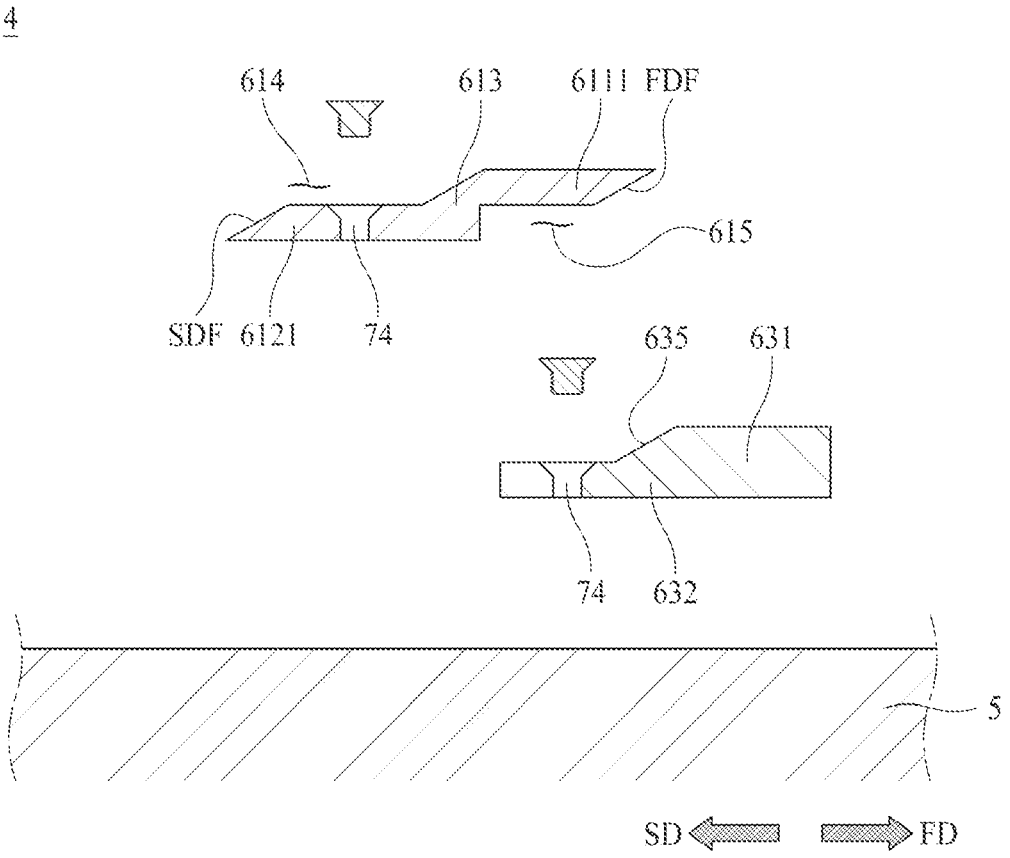
FIG. 11 is an exploded view of the positive electrode plate of FIG. 10.

Referring to FIGS. 10 and 11, the first covering member 611 may include a first reduction member 6111 and a first reduction surface FDF.

The first reduction member 6111 is formed to have a smaller size as the first reduction member 6111 extends in the first direction (arrow direction indicated by FD). The first reduction member 6111 may be disposed to cover a portion of the base positive electrode plate 63. In this case, the first reduction member 6111 may be disposed to cover the upper surface of the second base member 632.

The first reduction surface FDF is formed on the first reduction member 6111 and disposed to face the base positive electrode plate 63. The first reduction surface FDF may be formed to be inclined to have a greater height as the first reduction surface FDF extends in the first direction (arrow direction indicated by FD).

Referring to FIGS. 10 and 11, the first coupling member 612 may include a second reduction member 6121 and a second reduction surface SDF.

The second reduction member 6121 is formed to have a smaller size as the second reduction member 6121 extends in the second direction (arrow direction indicated by SD). The second reduction member 6121 may be disposed to cover a portion of the positive electrode body 5. In this case, the second reduction member 6121 may be disposed to cover the upper surface of the positive electrode body 5.

Figure 3:
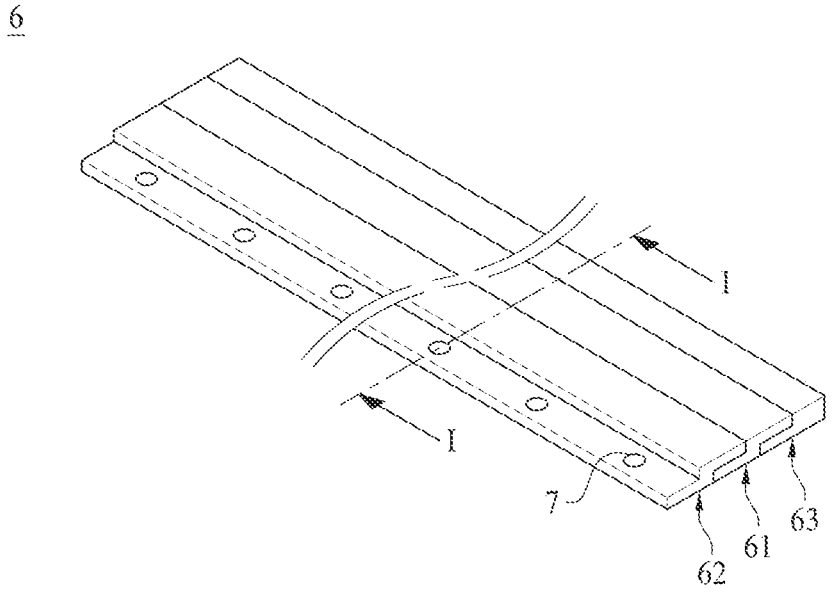
FIG. 3 is a schematic perspective view of a positive electrode plate in the apparatus for manufacturing a copper foil according to the present disclosure.
Figure 4:
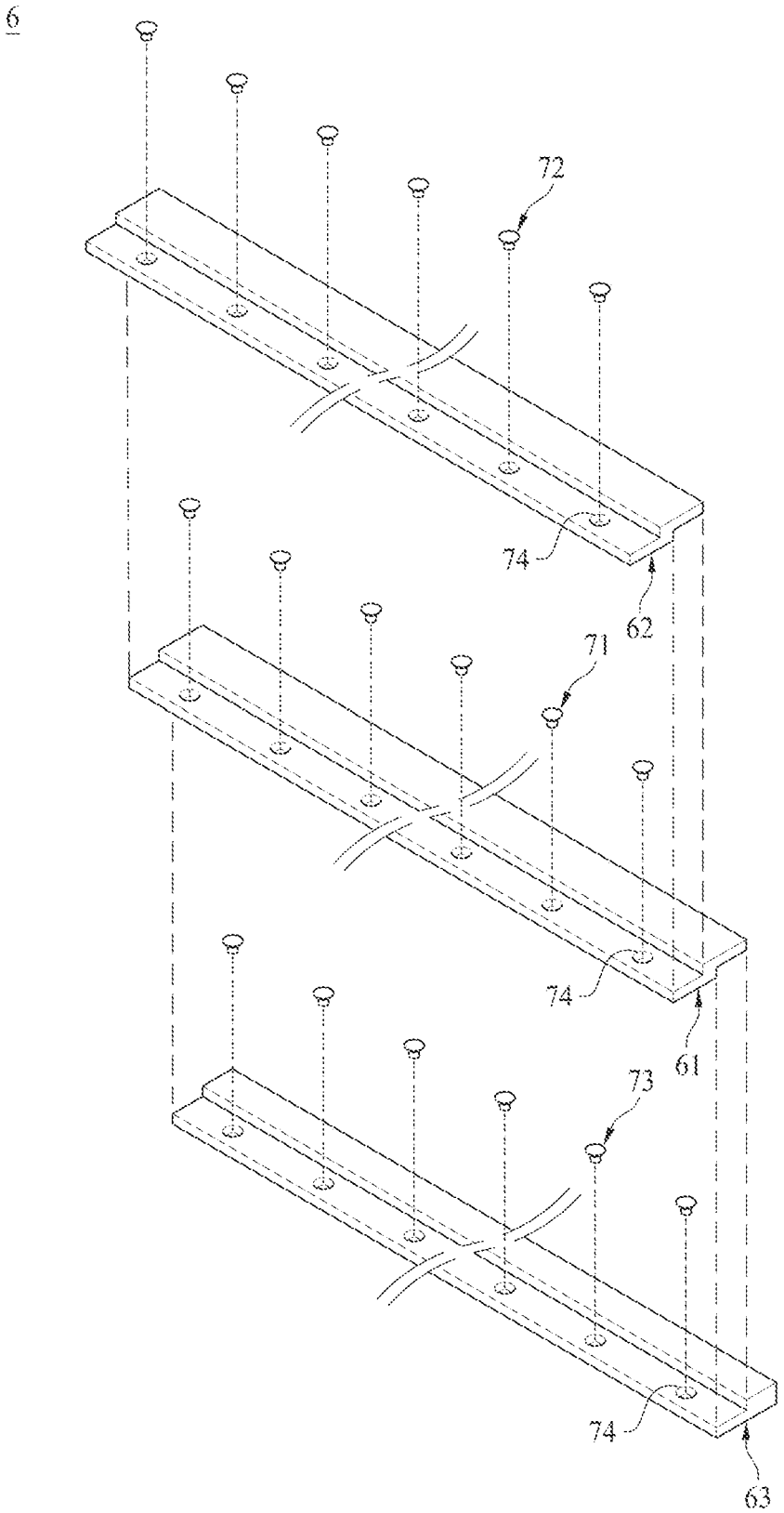
FIG. 4 is a schematic exploded perspective view of the positive electrode plate in the apparatus for manufacturing a copper foil according to the present disclosure.

The second reduction surface SDF is formed on the second reduction member 6121 and disposed to face the second positive electrode plate 62 (shown in FIG. 3). The second reduction surface SDF may be formed to be inclined to have a greater height as the second reduction surface SDF extends in the first direction (arrow direction indicated by FD).

Meanwhile, the second base member 632 may be formed to have a greater size as the second base member 632 extends in the first direction (arrow direction indicated by FD). Therefore, the second base member 632 may be formed at the same height as the first base member 631 at a portion in which the second base member 632 and the first base member 631 are coupled. In this case, a seating surface 635 may be formed on the second base member 632. The seating surface 635 may be formed to be inclined to have a greater height as the seating surface 635 extends in the first direction (arrow direction indicated by FD). When the first positive electrode plate 61 is coupled to the base positive electrode plate 63, the first reduction surface FDF may be disposed on the seating surface 635. The first reduction surface FDF and the seating surface 635 may be disposed to face each other and overlap each other.

The present disclosure described above is not limited to the above-described embodiments and the accompanying drawings, and it will be apparent to those skilled in the art to which the present disclosure pertains that various substitutions, modifications, and changes are possible without departing from the technical spirit of the present disclosure.

What is claimed is:

1. An apparatus for manufacturing a copper foil, comprising:

an electrodeposition unit configured to electrodeposit a copper foil in an electroplating method using an electrolyte; and a winding unit configured to wind the copper foil supplied from the electrodeposition unit, wherein the electrodeposition unit includes a negative electrode drum on which the electrodeposited copper foil is electrodeposited in the electroplating method using the electrolyte and a positive electrode unit electrically connected with the negative electrode drum through the electrolyte, the positive electrode unit includes a positive electrode body spaced apart from the negative electrode drum, a plurality of positive electrode plates disposed on an upper surface of the positive electrode body, and a plurality of fastening units fastening each of the positive electrode plates to the positive electrode body, a first positive electrode plate among the positive electrode plates is coupled to the positive electrode body by a first fastening member among the fastening units, a second positive electrode plate among the positive electrode plates is coupled to the positive electrode body by a second fastening member among the fastening units, and the second positive electrode plate includes a second covering member disposed on an upper surface of the first positive electrode plate to cover the first fastening member and a second coupling member into which the second fastening member is inserted, wherein the first fastening member is inserted into a fastening hole formed in the first positive electrode plate and coupled to the positive electrode body, and the second fastening member is inserted into a second fastening hole formed in the second positive electrode plate and coupled to the positive electrode body.

2. The apparatus of claim 1, wherein the first positive electrode plate includes a first covering member coupled to the positive electrode body to overlap a portion of a base positive electrode plate among the positive electrode plates, a first coupling member disposed to be spaced apart from the first covering member, and a first bending member connecting the first covering member and the first coupling member, and the first bending member is bent so that the first covering member and the first coupling member are disposed at different heights.

3. The apparatus of claim 1, wherein a base positive electrode plate among the positive electrode plates is coupled to the positive electrode body by a base fastening member among the fastening units, the first positive electrode plate includes a first covering member disposed on an upper surface of the base positive electrode plate to cover the base fastening member and a first coupling member into which the first fastening member is inserted, and the first covering member covers the base fastening member.

4. The apparatus of claim 3, wherein the base positive electrode plate includes a first base member spaced apart from the first positive electrode plate and a second base member connected to the first base member, the first positive electrode plate includes a first coupling groove disposed above the first coupling member and a first covering groove disposed under the first covering member, and the first covering member is disposed to cover the second base member inserted into the first covering groove.

5. The apparatus of claim 3, wherein the first positive electrode plate includes a first coupling groove disposed above the first coupling member and a first covering groove disposed under the first covering member, the first covering member is formed to have a uniform thickness as the first covering member extends in a first direction (arrow direction indicated by FD) from the first positive electrode plate toward the second positive electrode plate, and the first coupling member is formed to have a uniform thickness as the first coupling member extends in a second direction (arrow direction indicated by SD) opposite to the first direction (arrow direction indicated by FD).

6. The apparatus of claim 1, wherein the first positive electrode plate includes a first covering groove disposed under a first covering member, and the first covering member includes a first reduction member formed to have a smaller size as the first reduction member extends in a first direction (arrow direction indicated by FD) from the first positive electrode plate toward the second positive electrode plate.

7. The apparatus of claim 6, wherein the positive electrode plate includes a base positive electrode plate disposed in the first direction (arrow direction indicated by FD) from the second positive electrode plate toward the first positive electrode plate with respect to the first positive electrode plate, the first covering member includes a first reduction surface formed on the first reduction member and disposed to face the base positive electrode plate, and the first reduction surface is formed to be inclined to have a greater height as the first reduction surface extends in the first direction (arrow direction indicated by FD).

8. The apparatus of claim 1, wherein the first positive electrode plate includes a first covering member coupled to the positive electrode body to overlap a portion of a base positive electrode plate among the positive electrode plates and a first coupling member disposed to be spaced apart from the first covering member, and the second covering member is disposed above the first coupling member, and an upper surface of the second covering member and an upper surface of the first covering member are disposed at the same height.

9. The apparatus of claim 2, wherein the positive electrode plate includes the base positive electrode plate coupled to the positive electrode body, the first positive electrode plate includes a bending inclined surface formed on the first bending member, the base positive electrode plate includes a first base member spaced apart from the first positive electrode plate and a first inclined surface formed on the first base member to be disposed to face the bending inclined surface, the first bending member is formed to be inclined in a first direction (arrow direction indicated by FD) from the first coupling member toward the first covering member, and the first positive electrode plate is coupled to the base positive electrode plate so that the bending inclined surface moves along the first inclined surface.

10. The apparatus of claim 1, wherein the positive electrode plate includes a base positive electrode plate coupled to the positive electrode body, the base positive electrode plate is coupled to the positive electrode body between a left end of the positive electrode body and a right end of the positive electrode body, and the positive electrode plates are consecutively disposed to partially overlap each other in a direction in which the first positive electrode plate and the second positive electrode plate are disposed with respect to the base positive electrode plate.

* * * * *